US009410688B1

(12) United States Patent
Sutherland et al.

(10) Patent No.: US 9,410,688 B1
(45) Date of Patent: Aug. 9, 2016

(54) HEAT DISSIPATING ASSEMBLY

(71) Applicants: Mark Sutherland, Ft. Lauderdale, FL (US); Jose Suarez, Pembroke Pines, FL (US)

(72) Inventors: Mark Sutherland, Ft. Lauderdale, FL (US); Jose Suarez, Pembroke Pines, FL (US)

( * ) Notice: Subject to any disclaimer, the term of this patent is extended or adjusted under 35 U.S.C. 154(b) by 0 days.

(21) Appl. No.: 14/273,947

(22) Filed: May 9, 2014

(51) Int. Cl.
*F21V 29/00* (2015.01)

(52) U.S. Cl.
CPC ..... *F21V 29/22* (2013.01); *F21V 29/004* (2013.01); *F21V 29/248* (2013.01)

(58) Field of Classification Search
CPC . F21V 19/0045; F21V 29/507; F21V 29/004; F21K 9/175
USPC ..... 362/218, 373, 294, 249.02
See application file for complete search history.

(56) References Cited

U.S. PATENT DOCUMENTS

| | | | |
|---|---|---|---|
| D60,004 | S | 12/1921 | Adam |
| D78,750 | S | 6/1929 | Gunnison |
| D129,357 | S | 9/1941 | Greppin |
| D132,276 | S | 5/1942 | Greppin |
| D143,336 | S | 12/1945 | Morrison |
| D150,357 | S | 7/1948 | Herbster |
| D155,680 | S | 10/1949 | Baker |
| D164,606 | S | 9/1951 | Schlage |
| D234,797 | S | 4/1975 | De John et al. |
| 4,369,490 | A | 1/1983 | Blum |
| 4,396,882 | A | 8/1983 | Kellenbenz |
| 4,471,268 | A | 9/1984 | Brown et al. |
| D303,437 | S | 9/1989 | Mason |
| 4,910,654 | A | 3/1990 | Forge |
| D339,651 | S | 9/1993 | Vieyra |
| D365,159 | S | 12/1995 | Tinen |
| 5,604,411 | A | 2/1997 | Venkitasubrahmanian et al. |
| 5,652,504 | A | 7/1997 | Bangerter |
| D385,897 | S | 11/1997 | Lin |
| 5,738,436 | A | 4/1998 | Cummings et al. |
| D397,482 | S | 8/1998 | Binsukor |
| D405,216 | S | 2/1999 | Porter et al. |
| D413,137 | S | 8/1999 | Lin |
| 5,953,221 | A | 9/1999 | Kuhn et al. |
| 6,013,988 | A | 1/2000 | Bucks et al. |
| 6,016,038 | A | 1/2000 | Mueller et al. |
| 6,094,014 | A | 7/2000 | Bucks et al. |
| 6,147,458 | A | 11/2000 | Bucks et al. |

(Continued)

FOREIGN PATENT DOCUMENTS

| | | |
|---|---|---|
| WO | WO 2009/064433 | 5/2009 |
| WO | WO 2009/064434 | 5/2009 |

*Primary Examiner* — Anabel Ton
(74) *Attorney, Agent, or Firm* — Malloy & Malloy, P.L.

(57) ABSTRACT

An assembly for the dissipation of heat from an illumination structure of the type which includes one or more LEDs and a driver assembly operatively connected to the one or more LEDs. A primary heat sink is disposed in heat transferring relation to the components of a remainder of the illumination structure. A mount, also formed of a heat conductive material, is disposed in supporting or connected relation to the driver and in heat transferring relation to the primary heat sink. A compartment structure includes a hollow interior chamber, having heat insulating fluid disposed therein, and disposed in adjacent and/or aligned relation with the one LED so as to insulate it from heat generated by the driver assembly and other components of the light structure. The mount, primary heat sink and compartment structure are cooperatively disposed so as to define a flow path of heat away from the one or more LEDs to an area where it is dissipated exteriorly of the illumination structure.

21 Claims, 3 Drawing Sheets

(56) References Cited

U.S. PATENT DOCUMENTS 6,160,359 A 12/2000 Fleischmann
6,188,177 B1 2/2001 Adamson et al.
6,211,626 B1 4/2001 Lys et al.
6,234,645 B1 5/2001 Borner et al.
6,234,648 B1 5/2001 Borner et al.
6,250,774 B1 6/2001 Begemann et al.
6,304,464 B1 10/2001 Jacobs et al.
6,375,338 B1 4/2002 Cummings et al.
6,388,388 B1 5/2002 Weindorf et al.
6,472,828 B1 10/2002 Pruett et al.
D469,211 S 1/2003 Homann
6,561,690 B2 5/2003 Balestriero et al.
6,577,512 B2 6/2003 Tripathi et al.
6,586,890 B2 7/2003 Min et al.
6,608,617 B2 8/2003 Hoffknecht et al.
6,617,795 B2 9/2003 Bruning
6,642,674 B2 11/2003 Liao et al.
6,692,136 B2 2/2004 Marshall et al.
D490,182 S 5/2004 Benensohn
6,744,223 B2 6/2004 Laflamme et al.
D493,188 S 7/2004 Brueck
6,788,011 B2 9/2004 Mueller et al.
6,827,470 B2 12/2004 Sagal et al.
6,856,890 B2 2/2005 Muto et al.
6,917,482 B2 7/2005 Minamino
6,922,022 B2 7/2005 Bucks et al.
D509,016 S 8/2005 Benghozi
6,972,525 B2 12/2005 Bucks et al.
6,975,079 B2 12/2005 Lys et al.
7,038,399 B2 5/2006 Lys et al.
7,129,933 B1 10/2006 Nishikawa et al.
7,183,727 B2 2/2007 Ferguson et al.
7,186,000 B2 3/2007 Lebens et al.
7,202,608 B2 4/2007 Robinson et al.
7,233,115 B2 6/2007 Lys
7,252,385 B2 8/2007 Engle et al.
7,256,554 B2 8/2007 Lys
7,262,559 B2 8/2007 Tripathi et al.
D550,391 S 9/2007 Cesaro
D554,974 S 11/2007 Huang et al.
D556,075 S 11/2007 Teiber et al.
7,300,173 B2 11/2007 Catalano et al.
7,312,582 B2 12/2007 Newman, Jr. et al.
7,329,024 B2 2/2008 Lynch et al.
7,348,736 B2 3/2008 Piepgras et al.
7,352,138 B2 4/2008 Lys et al.
7,358,681 B2 4/2008 Robinson et al.
7,358,706 B2 4/2008 Lys
7,377,683 B2 5/2008 Koegler et al.
7,394,212 B2 7/2008 Wey et al.
7,420,335 B2 9/2008 Robinson et al.
7,459,864 B2 12/2008 Lys
D591,448 S 4/2009 Huang
7,522,615 B2 4/2009 Binder
D592,347 S 5/2009 Trott et al.
D592,348 S 5/2009 Trott et al.
7,556,404 B2 7/2009 Nawashiro
7,557,521 B2 7/2009 Lys
7,587,289 B1 9/2009 Sivertsen
D602,193 S 10/2009 Soderman et al.
D602,195 S 10/2009 Soderman et al.
7,602,158 B1 10/2009 Iacob
D604,008 S 11/2009 Soderman et al.
7,722,227 B2 5/2010 Zhang et al.
7,737,643 B2 6/2010 Lys
7,738,270 B2 6/2010 Chang
7,760,107 B1 7/2010 Stepps et al.
7,802,902 B2 9/2010 Moss et al.
7,810,960 B1 * 10/2010 Soderman ..... F21K 9/00 362/249.02
7,878,692 B2 * 2/2011 Soderman ..... F21V 15/01 362/249.02
7,980,736 B2 * 7/2011 Soderman ..... F21K 9/00 362/249.02
8,011,794 B1 9/2011 Sivertsen
8,029,158 B2 * 10/2011 Chen ..... F21K 9/00 362/249.02
8,098,021 B2 1/2012 Wang et al.
8,154,221 B2 4/2012 Godbole et al.
8,159,198 B2 4/2012 Dishman et al.
8,226,272 B2 * 7/2012 Chen ..... F21L 4/027 362/218
8,237,381 B2 8/2012 Harbers et al.
8,258,706 B2 9/2012 Maruyama et al.
8,344,639 B1 1/2013 Bahrehmand
8,348,470 B2 * 1/2013 Liu ..... F21V 29/004 362/249.02
8,360,614 B1 * 1/2013 Soderman ..... F21V 29/004 362/249.02
8,368,310 B1 2/2013 Roosli
8,398,253 B2 3/2013 Sivertsen
8,531,226 B2 9/2013 Montalbo et al.
8,534,873 B1 * 9/2013 Soderman ..... F21V 29/004 362/249.02
8,573,812 B2 * 11/2013 Joung ..... F21V 29/006 362/249.02
8,643,300 B1 2/2014 Stepps et al.
8,674,544 B2 3/2014 Rada et al.
8,714,797 B2 * 5/2014 Hwu ..... F21V 29/004 362/249.02
8,797,766 B2 8/2014 Delpapa et al.
8,957,610 B2 2/2015 Lee
9,014,829 B2 4/2015 Chemel et al.
9,054,584 B2 6/2015 Haight et al.
2003/0072160 A1 4/2003 Kuepper et al.
2003/0102845 A1 6/2003 Aker et al.
2004/0135523 A1 7/2004 Takahashi et al.
2005/0213047 A1 9/2005 Slobodin et al.
2006/0126328 A1 6/2006 Coushaine
2007/0114010 A1 5/2007 Upadhya et al.
2007/0139923 A1 6/2007 Negley et al.
2007/0223230 A1 9/2007 Trojanowski et al.
2007/0242461 A1 10/2007 Reisenauer et al.
2007/0279821 A1 12/2007 Sells
2008/0007944 A1 1/2008 Verfuerth et al.
2009/0109052 A1 4/2009 Stepps et al.
2009/0122553 A1 5/2009 Soderman et al.
2009/0195168 A1 8/2009 Greenfeld
2009/0278479 A1 11/2009 Platner et al.
2009/0303602 A1 12/2009 Bright et al.
2010/0134038 A1 6/2010 Shackle et al.
2010/0134047 A1 6/2010 Hasnain
2010/0271178 A1 10/2010 Ahmad
2010/0314641 A1 12/2010 Schmidt
2011/0012530 A1 1/2011 Zheng et al.
2011/0026251 A1 * 2/2011 Liu ..... F21V 29/004 362/249.02
2011/0095703 A1 4/2011 Wilson et al.
2011/0285298 A1 11/2011 Schwalenberg
2011/0317423 A1 * 12/2011 Chen ..... F21K 9/00 362/249.02
2012/0092870 A1 * 4/2012 Tralli ..... F21K 9/00 362/249.02
2012/0146505 A1 6/2012 Jonsson
2013/0043833 A1 2/2013 Katz et al.
2013/0257302 A1 10/2013 Canter et al.
2013/0271001 A1 10/2013 Kurachi et al.
2014/0301062 A1 10/2014 David et al.

* cited by examiner

HEAT DISSIPATING ASSEMBLY

BACKGROUND OF THE INVENTION

1. Field of the Invention

This invention is directed to a heat dissipation assembly for an illumination structure of the type which includes at least one LED and a driver operatively connected to the LED. A compartment structure, including an interior chamber having heat insulating fluid disposed therein, is disposed in predetermined adjacent and/or aligned relation to the LED and the driver assembly and/or other heat generating components to effectively restrict the exposure of the LED to heat.

2. Description of the Related Art

Various types of illumination assemblies which incorporate light emitting diodes (LED) as the light generating component have become increasingly popular in recent years. Such an increase in popularity is due, at least in part, to their overall efficiency as well as the ability to define various lighting arrays readily adaptable to numerous practical installations or applications.

Accordingly, LEDs are known for use in high power applications such as spotlights, automotive headlights, etc. However, due to their recognized versatility LEDs are also utilized extensively in various types of luminaires and/or like fixtures installed in conventional domestic and commercial environments. Such applications allow for the illumination of a given area in an efficient and variably decorative manner in that associated light fixtures may take the form of standard or customized lighting arrays, wall or ceiling mounted fixtures, inset lighting, etc. Further, LEDs provide increased energy efficiency and effective illumination output from the various types of light fixtures installed, while reducing maintenance costs associated therewith.

Therefore, the use of illumination assemblies incorporating collective LED arrays offer significant advantages in terms of increased lighting and efficiency of operation. However, certain disadvantages and problems associated with the use of LED based illumination assemblies are commonly recognized. More specifically, a primary concern with the structuring and use of LED illumination assemblies is the management or dissipation of excessive heat generated by the LED array. More specifically, the light intensity generated by an LED light source is generally a proportional function of its operational temperature. As such, LED illumination assemblies tend to generate a significant amount of heat during their operation, which in turn may derogatorily affect the light generated by the LED array as well as reduce the reliability and operational life thereof. Accordingly, the operable life of many LED based illumination assemblies may be significantly reduced due to premature failure of one or more light emitting diodes associated with a light fixture or other device.

Therefore, it is commonly recognized in the lighting industry that heat management and more specifically, heat dissipation is a critical structural and operational consideration in the manufacture, use, installation and overall viability of illumination assemblies incorporating light emitting diodes as the primary or exclusive light generating structure. Known attempts to overcome the problems associated with the generation of excessive heat involve the creation of diverse heat dissipating structures. By way of example, printed circuit boards have been disposed in a multi-layered or stacked array in attempt to transfer heat away from the LED array. Alternatively, one or more printed circuit boards associated with the operational control of the LED light generating structures include a metal core disposed and structured to further effect heat dissipation.

Other known or conventionally proposed solutions to the heat management problem include the utilization of a heat absorber including a heat conductive resin disposed in communicating relation with the circuitry of the LED array. Also, heat absorbing structures may be utilized which have a large physical configuration such as, but not limited to, a multi-finned structure providing a conductive path of heat transfer towards an area of dissipation. However, many known attempts do not effectively accomplish optimal heat transfer, resulting in lower operational performance and a reduced operational life as generally set forth above.

Accordingly, there is a long recognized need in the lighting industry for an efficient and practical heat dissipation assembly preferably of the type which may be easily included in the structure of a light fixture. Such a proposed assembly would allow the light fixture to assume any number of design configurations best suited to a specific application which is structured to effectively dissipate heat. As such, an LED based light assembly would be capable of an optimal level of light generation, while at the same time enjoying an extended operational life. Also, such an improved proposed light fixture should also include structural components which serve to effectively isolate or segregate the conductive material components associated with heat dissipation from direct contact with any type of electrical conductor.

Therefore, the proposed light fixture assembly would accomplish effective heat dissipation from a LED based illumination assembly, while at the same time assuring operational safety. Further, the proposed light fixture would be capable of sufficient structural and operational versatility to permit the light fixture to assume any of a variety of utilitarian and aesthetic configurations.

SUMMARY OF THE INVENTION

The present invention is directed to an assembly which is structured to dissipate heat from an illumination structure of the type which includes one or more LEDs defining an illumination source of the illumination structure. In addition, the illumination structure includes a driver assembly operatively connected to the one or more LEDs and facilitating its operation. As used herein, the term "driver assembly" or "driver" is to be broadly interpreted and may include an electrical circuit or other electronic component(s) used to control another circuit or other electronic component. In the present invention the driver assembly is used to operatively control the one or more LEDs.

Additional structural and operative features of the illumination structure and the heat dissipation capabilities associated therewith include a primary heat sink formed of heat conductive material and disposed in heat transferring relation to other heat generating portions of the illumination structure. Also, a mounting structure or "mount" is formed of heat conductive material and is disposed in connected and/or at least partially supporting relation to the driver assembly. Further, in at least one preferred embodiment the mount defines a secondary or supplementary heat sink and is disposed in heat transferring relation between the driver assembly and the primary heat sink. As a result, the mount and the primary heat sink collectively and at least partially define a path of heat flow from the driver assembly and/or other heat generating components of the light structure, to an area where the heat is safely or preferably dissipated from the light structure. Therefore, the present invention comprises a cooperative and collective structuring and positioning of the mount and primary heat sink to define the aforementioned flow path of heat from the driver assembly to an area for heat dissipation, such as an area or space located on the exterior of the light structure.

Additional structural and operative features of the heat dissipating assembly of the present invention include the provision of a compartment structure. Moreover, the compartment structure includes an interior chamber which is at least partially hollow or open, at least to the extent of containing air or other heat insulating fluid therein. Further, the compartment structure, at least generally, and the interior chamber, more specifically, are disposed relative to the one or more LEDs to effectively insulate the one or more LEDs from heat. As such, the compartment structure and/or interior chamber are disposed sufficiently adjacent and/or in predetermined aligned relation with the one or more LEDs so as to restrict heat, which may be generated by other components of the light structure, from reaching or otherwise affecting the one or more LEDs.

As explained in greater detail hereinafter, one or more preferred embodiments of the heat dissipating assembly comprise the chamber and heat insulating fluid disposed therein, being located in a predetermined alignment with the at least one LED. As such, the heat insulating fluid disposed within the interior chamber of the compartment structure will at least partially restrict the LED(s) from being exposed to heat generated by, at least the driver assembly and possibly other heat generating components of the illumination structure. Moreover, the compartment structure and interior chamber may be sufficiently adjacent and/or substantially aligned with both the driver assembly and the at least one LED. As a result, the heat generated by at least the driver assembly will be restricted from passing through the heat insulating fluid within the chamber to the LED. Such a concurrent alignment or adjacent positioning of the chamber may be accomplished by disposing the compartment structure and/or the interior chamber thereof in an at least partially "sandwiched" relation, substantially between the mount and the primary heat sink.

It is emphasized that the compartment structure and its chamber may be independently structured, disposed and/or positioned in heat insulating relation to the one or more LEDs. However, the compartment structure and interior chamber may also be disposed on or structurally associated with various components of the illumination structure. By way of example, the mount connected to and/or otherwise associated with the driver assembly, such as by being in heat transferring relation thereto, can be configured to include and/or at least partially define the compartment structure as a part thereof. Somewhat similarly, the compartment structure can be more closely associated with or otherwise connected to and or formed at least partially on the primary heat sink. Further, the mount and primary heat sink can be cooperatively disposed, dimensioned and configured to facilitate the positioning of the compartment structure and interior chamber therebetween. In any of the above noted structural embodiments, at least the interior chamber of the compartment structure is disposed in sufficiently adjacent relation to the one or more LEDs to restrict the passage of heat through the heat insulating fluid disposed within the chamber. It is further noted that the heat being dissipated or directed away from the one or more LEDs may be primarily or partially generated by the driver assembly and/or other components of the illumination structure.

Accordingly, one or more preferred embodiments of the heat dissipating assembly of the present invention include a strategic location of the interior chamber of the compartment structure, relative to the primary heat sink and secondary heat sink (heat conductive material of the mount). Such cooperative positioning and structuring of the compartment structure, mount and primary heat sink facilitate the aforementioned flow path of heat from at least the driver assembly into and along the heat conductive material of the mount, into and along the primary heat sink to an area, preferably exteriorly of the illumination structure, where the heat can be safely dissipated.

Is also emphasized that the dimensions, configurations and other structural features of the mount, compartment structure and associated interior chamber, as well as the primary heat sink can vary based on the overall size and configuration of the illumination structure and/or its application, environment of use, etc. Further, the aforementioned heat insulating fluid disposed within the interior chamber may be air or other fluid which restricts the passage of heat there through thereby accomplishing the intended heat insulation of the correspondingly disposed one or more LEDs.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 3:
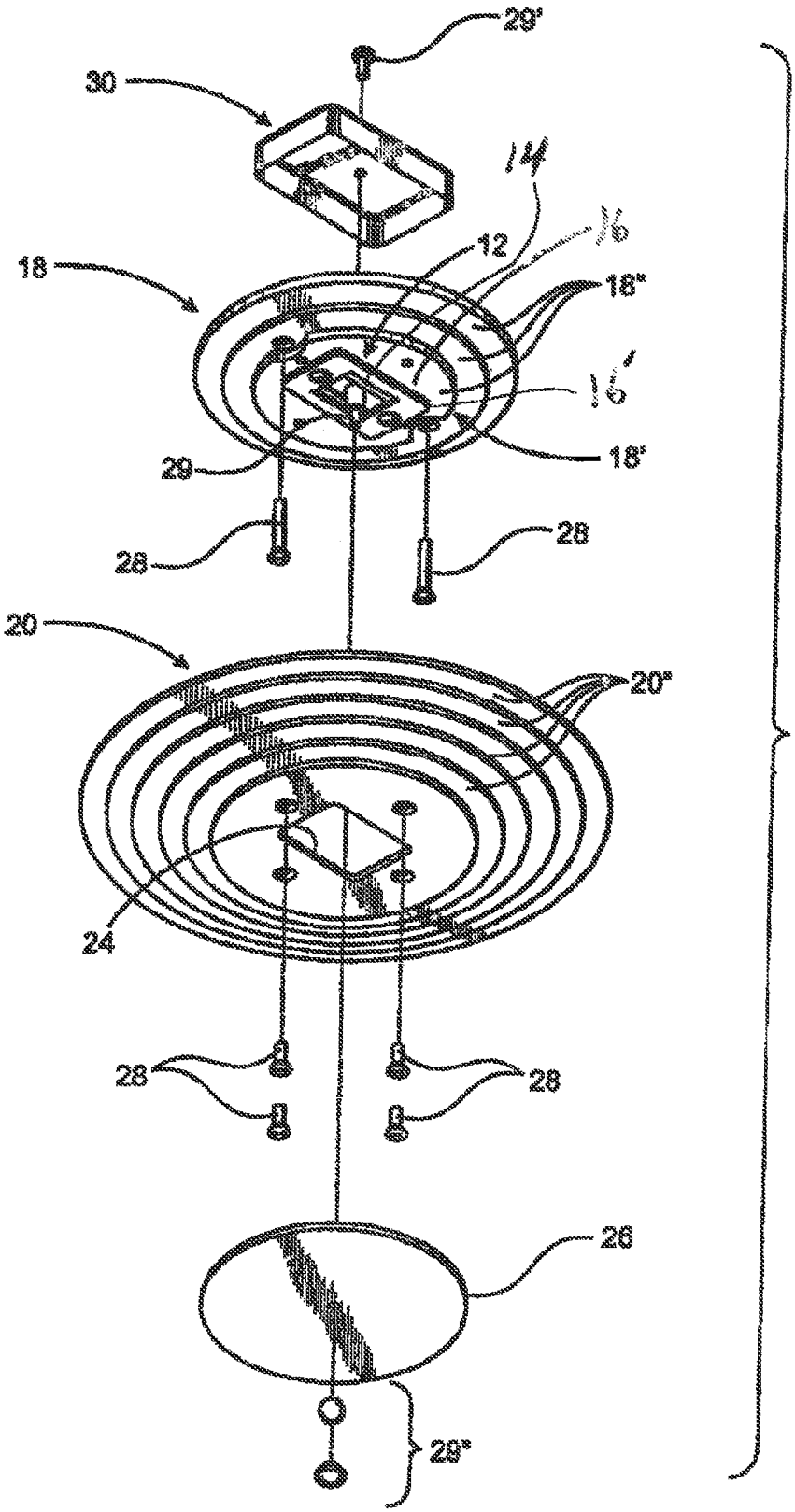
FIG. 3 is an exploded perspective view of the various operative features and structural components associated with the light fixture as represented in FIGS. 1 and 2.
Figure 4:
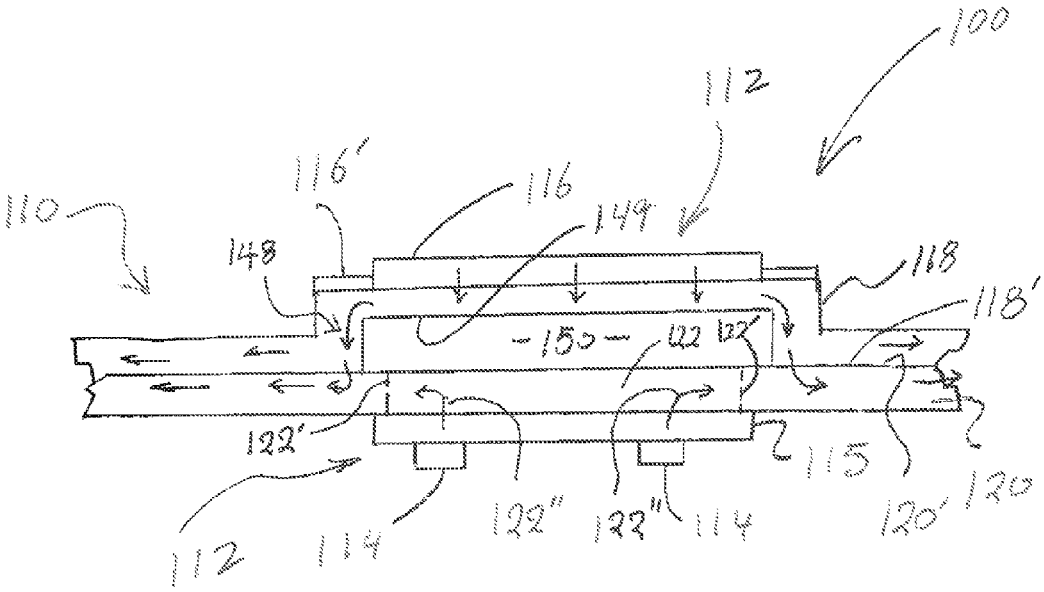
FIG. 4 is a schematic representation of the heat dissipating assembly of the present invention structurally and operatively adapted to be used in combination with a light fixture, including an LED illumination source, of the type represented in FIGS. 1-3.

As shown in the accompanying drawings, the present invention is directed to a heat dissipating assembly, generally indicated as 100, as schematically represented in FIG. 4. However, for the purpose of clarity and by way of example, FIGS. 1-3 disclose a representative light fixture generally indicated as 10, with which the heat dissipating assembly 100 may be used. It is emphasized that the heat dissipating assembly 100 may vary in structure and operation from the light fixture 10 of FIGS. 1-3, as pointed out in greater detail hereinafter, without departing from the intended spirit and scope of the present invention.

Accordingly, the light fixture 10 is of the type which may be installed in any of a variety of commercial, domestic or other sites and is decorative as well as functional to effectively illuminate a given area or space in the vicinity of the installed location. More specifically, the light fixture 10 includes an illumination structure generally indicated as 12 comprising one or more light emitting diodes (LED) 14 connected to electrical control circuitry generally indicated as 16. The control circuitry 16 may comprise a printed circuit structure 16' or printed circuit board having the various electrical or circuitry components integrated therein. As also set forth in greater detail hereinafter, the heat dissipating assembly 100 as represented in FIG. 4 includes control circuitry, which includes or is defined by a driver assembly. Again, for purposes of clarity the driver assembly and/or control circuitry is represented in FIG. 4 as 116.

In addition, the light fixture 10 includes a mounting assembly or "mount" generally indicated as 18, which may or may not be in the form of a plate or disk-like configuration as also represented. It is emphasized that the specific structural configuration and dimension of the mount or mounting assembly 18 may vary from that other than the represented plate or disk like shape. When assembled, the mount 18 is connected in supporting relation to the illumination structure 12 such that the control circuitry and/or driver assembly 16, is disposed in direct confronting and heat transferring engagement with a corresponding portion of the mount 18 as clearly represented in FIG. 3, as well as the schematic representation of the heat dissipating assembly 100 represented in FIG. 4. Additional structural features of the mount or mounting assembly 18 include its formation from a heat conductive material having sufficient heat conductive properties to act as a heat sink. As such, the mount 18 may be formed from a metallic or other material which facilitates the transfer of heat. Such confronting engagement between the illumination structure 12 and the mounting assembly 18 serves to adequately support and position the illumination structure 12 in its intended orientation substantially co-axial to the mounting assembly 18 and also facilitates the transfer and dissipation of heat from the illumination structure 12 to and throughout the mounting assembly 18. As again emphasized and explained in greater detail hereinafter with primary reference to FIG. 4, the structural features of the heat dissipating assembly 100 may differ from that disclosed in the representative light fixture 10.

In order to enhance and render most efficient, the heat dissipating capabilities of the light fixture 10, a primary heat sink is included in the form of a cover structure generally indicated as 20. As represented in both the light fixture 10 of FIGS. 1-3 and the heat dissipating assembly 100 as represented in FIG. 4, the primary heat sink 20 is connected directly to the mount mounting assembly 18 and is therefore in heat transferring relation therewith. More specifically, the primary heat sink or cover structure 20 is also formed of a heat conductive material demonstrating sufficient heat conductive properties to be capable of heat transfer throughout its structure. Therefore, efficient heat transfer from the illumination structure 12 and control circuitry or driver assembly 16 to the mounting assembly 18 and therefrom to the cover structure 20 is facilitated by the continuous confronting engagement of correspondingly positioned surfaces 18' and 20' respectively.

Figure 2:
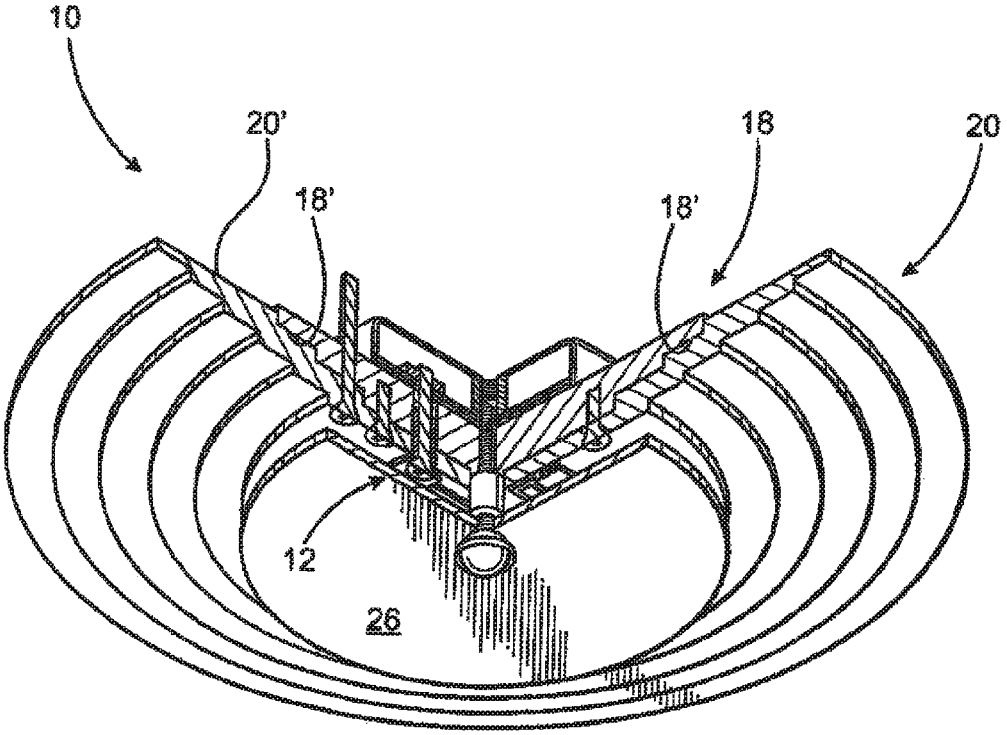
FIG. 2 is a bottom perspective view in partial cutaway showing structural details of the embodiment of FIG. 1.

Heat dissipation is further facilitated by the structuring of the cover structure 20 to have an overall larger dimension than that of the mounting assembly 18. As such, at least a portion of the "interior surface" 20' of the cover structure 20 may be disposed in substantially continuous confronting engagement with the correspondingly disposed surface 18' to facilitate heat transfer through the mounting assembly 18 and the cover structure 20 when interconnected into the assembled orientation of FIGS. 1 and 2. Such heat transfer and the eventual dissipation of heat from the control circuitry or driver assembly 16 and illumination structure 12, through the mounting assembly 18 and the confronting surface portions 18' and 20', is further facilitated by a portion of the surface 20', such as the outer portion of the surface 20', being exposed to the exterior of the light fixture 10, as best represented in FIG. 2.

Cooperative structural features of the illumination assembly 12, the mounting assembly 18, and the cover structure 20 include an apertured construction comprising the provision of an aperture or opening 24 in a center or other appropriate portion of the cover structure 20. The opening 24 is disposed, dimensioned and configured to receive the illumination structure 12 therein or at least be in alignment therewith. As such, the light generated by the one or more light emitting diodes 14 pass through the opening 24 so as to be directed or channeled outwardly from the exposed or outermost surface of the cover assembly 20. The surrounding area is thereby effectively illuminated.

Additional structural features associated with the directing or channeling of light from the illumination structure 12 through the opening 24 include a light shield 26 which may be formed of a transparent and/or translucent material such as glass, plastic, etc. The light shield 26 may be structured to further direct or channel, in a more efficient manner, the illumination generated by the LEDs 14 of the illumination assembly 12. Accordingly, the light shield 26 is disposed in overlying but spaced relation to the opening 24 and to the illumination assembly 12 when the various components of the light fixture assembly 10 are in an assembled orientation as represented in FIGS. 3 and 4.

Interconnection of the various components into the assembled orientation of FIG. 3 may be accomplished by a plurality of generally conventional connectors as at 28 and a decorative or utilitarian attachment assembly 29, 29', 29", etc. Further, a housing, enclosure, junction box or like structure 30 is provided for the housing of wiring, conductors and other electrical components. Housing 30 is connected to the under surface or rear portion of the mounting assembly 18 and may further include supportive backing plates or the like. These backing plates facilitate the interconnection and support of a remainder of the light fixture assembly 10 when it is attached to or supported by ceiling, wall or other supporting surface or structure. Further, an electrical interconnection to an appropriate source of electrical energy is provided.

Figure 1:
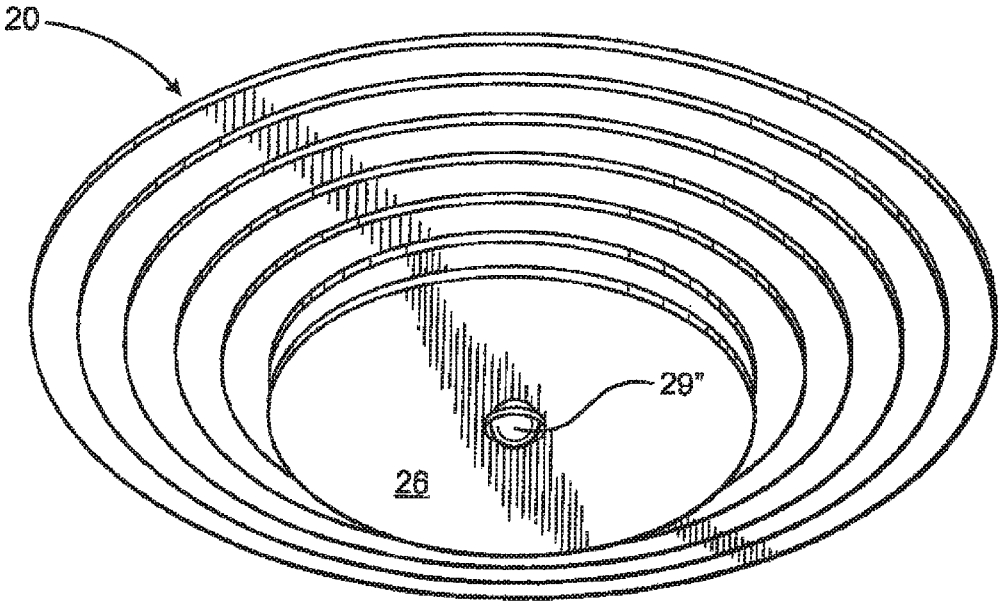
FIG. 1 is a bottom perspective view of a light fixture including an LED illumination source of the type with which a heat dissipation assembly of the present invention may be used.

Therefore, the heat dissipating assembly 100 as represented in FIG. 4 is operative in the practical application and environment of a light fixture incorporating one or more LEDs such as, but not limited to, the light fixture 10 as set forth above and generally represented in FIG. 1-3.

More specifically and with primary reference to FIG. 4, the heat dissipating assembly 100 of the present invention is structurally and operatively adapted to be used with a light fixture 110 such as of the type, but not limited to, the light fixture 10 disclosed in FIGS. 1 through 3 and described above. Further, the light fixture 110 includes an illumination structure 112 comprising one or more LEDs 114. In addition, control circuitry 116 is also included in the illumination structure 112 and includes a driver assembly of the type operatively structured to drive and/or operate the one or more LEDs. For purposes of clarity, the control circuitry and the driver assembly will both be indicated and synonymously referred to as 116.

While not specifically disclosed in the schematic representation of FIG. 4, operative interconnecting wiring or other connective circuitry is established through remaining portions of the light fixture 112, between the driver assembly 116 and the LEDs 114. Such interactive and cooperatively structured wiring or circuitry may include a printed circuit board or other appropriate circuitry structure 116' and an appropriately structured printed circuit board and/or printed circuitry 115. However, it is noted that the structure 115 may also serve as or be structured to interconnect and/or secure the one or more LEDs 114 in an appropriate, operative disposition within the light fixture 110, relative to the remaining components of the heat dissipating assembly 100. Further by way of example, the structure 115 may be an at least partially structured in the form of a conventional printed circuit board, printed circuitry, connector member, etc. In addition, structure 115 may be formed, at least in part, from a heat conductive material having sufficient heat conductive properties to direct heat away from the one or more LEDs 114 such as through, but not limited to, correspondingly disposed sections or segments 122 of a primary heat sink 120.

Therefore, additional structural features of the heat dissipating assembly 100 include the provision of a primary heat sink 120. The primary heat sink 120 may substantially or at least partially correspond to the heat sink structure 20 as represented in FIGS. 1-3. As such, the one or more LEDs 114 of the illumination structure 112 are mounted in heat communicating relation to the primary heat sink 120 either independently or by virtue of the printed circuitry connector structure 115, as described above. In addition, the dimension, configuration and overall structure of the primary heat sink 120 is such as to facilitate the transfer or flow of heat away from heat generating components of the heat dissipating assembly 100 including, but not limited to, the driver assembly 116, to a location or area exteriorly of the illumination structure 112. Therefore, the primary heat sink 120 serves to transfer heat away from the one or more LEDs 114, driver 116, additional control circuitry or electronic components 116', connector structure 115, etc.

Moreover, additional structural and operative features associated with the heat dissipating assembly 100 includes the provision of a "mount" or mounting assembly 118. The mount 118 is also formed from a heat conductive material and as such may also serve as a heat sink and/or secondary heat sink by virtue of its predetermined disposition in heat transferring relation to the primary heat sink 120. As clearly represented in FIG. 4, the cooperative disposition of the mount 118 and the primary heat sink 120 is such as to establish a heat dissipating flow and/or heat transferring relation therebetween. This may be accomplished by correspondingly disposed surfaces 118' and 120' being disposed in confronting engagement with one another. An alternative construction may also be defined by a more integrated structuring of the mount 118 and primary heat source 120 such as by an integral, one-piece construction thereof.

In order to further facilitate the dissipation of heat away from the one or more LEDs 114, as well as from the driver assembly 116, a compartment structure generally indicated as 148 comprises an at least partially hollow interior 149 of the chamber 150 in which a heat insulating fluid is present. The heat insulating fluid may be air, other gas or fluids having sufficient heat insulating properties to at least partially insulate the one or more LEDs 114 from heat generated by or derived from heat generating components of the illumination structure 112 such as, but not limited to, the control circuitry or driver assembly 116. In more specific terms, the at least partially hollow interior 149 of the chamber 150 is disposed adjacent to both the control circuitry and or driver assembly 116, 116' and the one or more LEDs 114. In a preferred embodiment, the chamber 150 and the air or other insulating fluid contained therein is disposed in substantially aligned relation between the driver assembly 116 and the one or more LEDs 114.

As a result of the heat transferring capabilities of both the primary heat sink 120 and the mount or secondary heat sink 118, heat generated by the driver assembly 116, as well as other components associated with the illumination structure 112, will be directed therefrom, through the heat conductive material of the mount 118 and outwardly and away from the LEDs 114. As schematically represented by the collection of directional arrows included within FIG. 4, a "flow path" of heat will be established facilitating the travel of heat from the generating components of the illumination structure 112 through the mount 118, along the length thereof and/or therefrom through the primary heat sink 120. The dissipating heat will further be transferred to an area or location exteriorly of the illumination structure 112, where such heat may be safely dissipated. The existence and presence of the "air pocket" or "heat insulating fluid pocket" within the chamber 150 in aligned, adjacent relation between the driver assembly 116 and one or more LEDs 114 will at least partially but effectively facilitate the transfer of heat away from the one or more LEDs 114 and restrict the passage of heat through the chamber 150 defined by hollow interior 149 of the compartment structure 148.

Yet another embodiment and/or structural modification of the heat dissipating assembly 100, as represented in FIG. 4, may include the absence or at least partial removal of the indicated section or segment 122 of the primary heat sink 120. For purposes of clarity the referred to segment or section 122 is defined, at least partially, by broken lines 122'. However, it is noted that the absence of the segmented portion 122 may at least partially or minimally restrict the transfer of or flow of heat away from the one or more LEDs 114, such as indicated by corresponding directional arrow 122".

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly for the dissipation of heat from an illumination structure, which includes at least one LED, said assembly comprising:

a driver assembly operatively connected to the one LED and defining a part of the illumination structure, a primary heat sink formed of heat conductive material and disposed in heat transferring relation to remaining portions of the illumination structure, a mount disposed in at least partially interconnecting relation between said driver assembly and remaining portions of the illumination structure, a compartment structure disposed and structured to at least partially insulate the one LED from heat generated by at least some of the remaining portions of the illumination structure, and said compartment structure at least partially disposed on said mount in adjacent relation to the one LED.

2. An assembly as recited in claim 1 wherein said compartment structure comprises an interior chamber having an at least partially hollow interior and including a heat insulating fluid disposed within said hollow interior.

3. An assembly as recited in claim 2 wherein said compartment structure and said interior chamber collectively comprise an air pocket.

4. An assembly as recited in claim 2 wherein said interior chamber is disposed in substantially heat insulating relation to the one LED, relative to said driver assembly.

5. An assembly as recited claim 2 wherein said interior chamber is disposed in heat insulating relation to the one LED and between and in substantially aligned relation with said driver assembly and the one LED.

6. An assembly as recited in claim 2 wherein said interior chamber is disposed in substantially adjacent relation to the one LED.

7. An assembly as recited in claim 6 wherein said interior chamber comprises a heat insulating fluid disposed therein.

8. An assembly as recited in claim 6 wherein said mount is formed of a heat conductive material and disposed in heat transferring relation to said driver assembly.

9. An assembly as recited in claim 6 wherein said mount is formed of a heat conductive material and disposed to at least partially define a flow path of heat from said driver assembly to said primary heat sink.

10. An assembly as recited in claim 9 wherein said primary heat sink is disposed between said mount and the one LED and in heat transferring relation to said mount.

11. An assembly as recited in claim 10 wherein said mount and said primary heat sink collectively and at least partially define a flow path of heat from said driver assembly to an exterior of the illumination structure.

12. An assembly as recited in claim 10 wherein said primary heat sink is disposed in heat transferring relation to the one LED.

13. An assembly as recited in claim 6 wherein said primary heat sink at least partially defines a flow path of heat from said driver assembly and the one LED to an exterior of the illumination structure.

14. An assembly as recited in claim 13 wherein said interior chamber comprises an at least partially hollow interior including a heat insulating fluid disposed therein.

15. An assembly for the dissipation of heat from an illumination structure including at least one LED, said assembly comprising:

a driver assembly operatively connected to the one LED, a primary heat sink formed of heat conductive material and disposed in heat transferring relation to the illumination structure, a mount at least partially formed of heat conductive material and disposed in heat transferring relation between the driver assembly and said primary heat sink, a compartment structure at least partially disposed between said mount and the one LED and including an interior chamber having heat insulating fluid disposed therein, said interior chamber disposed and dimensioned to at least partially insulate the one LED from heat generated from at least said driver assembly, and said compartment structure and said interior chamber are disposed on said mount.

16. An assembly as recited in claim 15 wherein said interior chamber is disposed in substantially adjacent, heat insulating relation to said one LED.

17. An assembly as recited in claim 15 wherein said interior chamber is at least partially formed in said mount in substantially aligned relation between said driver assembly and the one LED.

18. An assembly as recited in claim 15 wherein said compartment structure is at least partially formed on said mount adjacent said primary heat sink and in adjacent, aligned, heat insulating relation to the one LED.

19. An assembly as recited in claim 15 wherein said mount comprises a secondary heat sink disposed in engaging, heat transferring relation with said driver assembly and said primary heat sink.

20. An assembly as recited in claim 19 wherein said compartment structure is disposed at least partially between said secondary heat sink and said primary heat sink, said interior chamber disposed between and in substantially aligned relation to said driver assembly and the one LED.

21. An assembly as recited in claim 20 wherein said insulating fluid comprises air, said compartment structure and said interior chamber collectively defining an air pocket.

* * * * *